US009784172B2

(12) United States Patent
Tobergte et al.

(10) Patent No.: US 9,784,172 B2
(45) Date of Patent: Oct. 10, 2017

(54) LIQUID-COOLED INTERNAL COMBUSTION ENGINE WITH SELECTOR GUIDE VALVE, AND METHOD FOR CONTROLLING THE SELECTOR GUIDE VALVE OF AN INTERNAL COMBUSTION ENGINE OF SAID TYPE

(71) Applicant: Ford Global Technologies, LLC, Dearborn, MI (US)

(72) Inventors: Michael Tobergte, Cologne (DE); Bernd Steiner, Bergisch Gladbach (DE); Kay Hohenboeken, Cologne (DE); Bert Pingen, Swisttal (DE); Stefan Quiring, Leverkusen (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 219 days.

(21) Appl. No.: 14/595,989

(22) Filed: Jan. 13, 2015

(65) Prior Publication Data

US 2015/0198079 A1 Jul. 16, 2015

(30) Foreign Application Priority Data

Jan. 16, 2014 (DE) ..... 10 2014 200 667

(51) Int. Cl.

| | |
|---|---|
| ***F01P 3/00*** | (2006.01) |
| ***F01P 3/02*** | (2006.01) |
| ***F01P 7/14*** | (2006.01) |
| *F01P 7/16* | (2006.01) |

(52) U.S. Cl.

CPC *F01P 3/02* (2013.01); *F01P 7/14* (2013.01); *F01P 7/165* (2013.01); *F01P 2003/027* (2013.01); *F01P 2007/146* (2013.01)

(58) Field of Classification Search

CPC ..... F01P 7/165; F01P 2007/146
USPC ..... 123/41.29
See application file for complete search history.

(56) References Cited

U.S. PATENT DOCUMENTS

| | | | | |
|---|---|---|---|---|
| 4,539,942 A * | 9/1985 | Kobayashi | ..... | F01P 7/08 123/41.1 |
| 2002/0195067 A1* | 12/2002 | Murakami | ..... | F01P 3/20 123/41.1 |

FOREIGN PATENT DOCUMENTS

| | | | | |
|---|---|---|---|---|
| DE | 10000299 A1 | 7/2001 | | |
| DE | 102006055536 A1 | 6/2008 | | |
| DE | 202013102963 U1 | 7/2013 | | |
| DE | 202013103743 U1 | 8/2013 | | |
| FR | 2827361 A1 * | 1/2003 | ..... | F01P 7/16 |

* cited by examiner

*Primary Examiner* — Jacob Amick
*Assistant Examiner* — Charles Brauch
(74) *Attorney, Agent, or Firm* — Greg Brown; McCoy Russell LLP

(57) ABSTRACT

A selector guide valve in cooling system of an internal combustion engine is provided. The selector guide valve includes a first control drum independently rotatable and including an inlet receiving engine coolant from a pump and a plurality of coolant openings extending through the first control drum and a second control drum independently rotatable, circumferentially surrounding the first control drum, and including a plurality of coolant openings extending through the second control drum.

2 Claims, 8 Drawing Sheets

LIQUID-COOLED INTERNAL COMBUSTION ENGINE WITH SELECTOR GUIDE VALVE, AND METHOD FOR CONTROLLING THE SELECTOR GUIDE VALVE OF AN INTERNAL COMBUSTION ENGINE OF SAID TYPE

CROSS REFERENCE TO RELATED APPLICATIONS

The present application claims priority to German Patent Application No. 102014200667.8, "LIQUID-COOLED INTERNAL COMBUSTION ENGINE WITH SELECTOR GUIDE VALVE, AND METHOD FOR CONTROLLING THE SELECTOR GUIDE VALVE OF AN INTERNAL COMBUSTION ENGINE OF SAID TYPE," filed Jan. 16, 2014, the entire contents of which are hereby incorporated by reference for all purposes.

FIELD

The present disclosure relates to an internal combustion having a cooling system with a selector guide valve.

BACKGROUND AND SUMMARY

Liquid cooling systems are used in internal combustion engines to remove heat from various components in the engine during combustion operation. Many cooling system includes separate cylinder head and cylinder block coolant jackets due to their different cooling needs during different periods of engine operation. The coolant jackets can include one or more coolant passages for circulating coolant through the cylinder head or cylinder block.

Separate thermostats can be used to control coolant flow through each of the cylinder head and cylinder block. However, using thermostats in this way has a number of drawbacks. For example, using multiple thermostats can increase the size of the cooling system as well as the cost of the system.

Proportional valves have been developed to enable flow into multiple jackets to be controlled via a single apparatus. However, the Inventors have recognized several drawbacks with current proportional valves. For instance, proportional valves may malfunction due to contaminants in the coolant which may collect between a housing and a rotatable drum in the valve. The collection of the particulates in the valve may lead to malfunction or failure of the proportional valve. For instance, the valve may jam and rotation of components in the valve may be constrained and in some cases completely inhibited. Such a malfunction may lead to damage and in some cases failure of the cooling system and therefore the engine due to the lack of coolant circulation therein.

As such in one approach, a selector guide valve in cooling system of an internal combustion engine is provided. The selector guide valve includes a first control drum independently rotatable and including an inlet receiving engine coolant from a pump and a plurality of coolant openings extending through the first control drum and a second control drum independently rotatable, circumferentially surrounding the first control drum, and including a plurality of coolant openings extending through the second control drum. Using a first control drum and second control drum independently rotatable from one another in a selector guide valve decreases the likelihood of valve malfunction (e.g., valve jamming) due to particulate formation in the valve. In particular, rotation of one of the control drums while the other drum is malfunctioning can increase the likelihood of the valve becoming unstuck. Additionally, providing two control drums in the valve increases the adjustability of the valve, further decreasing the likelihood of valve malfunction.

The above advantages and other advantages, and features of the present description be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED DESCRIPTION

Figure 1:
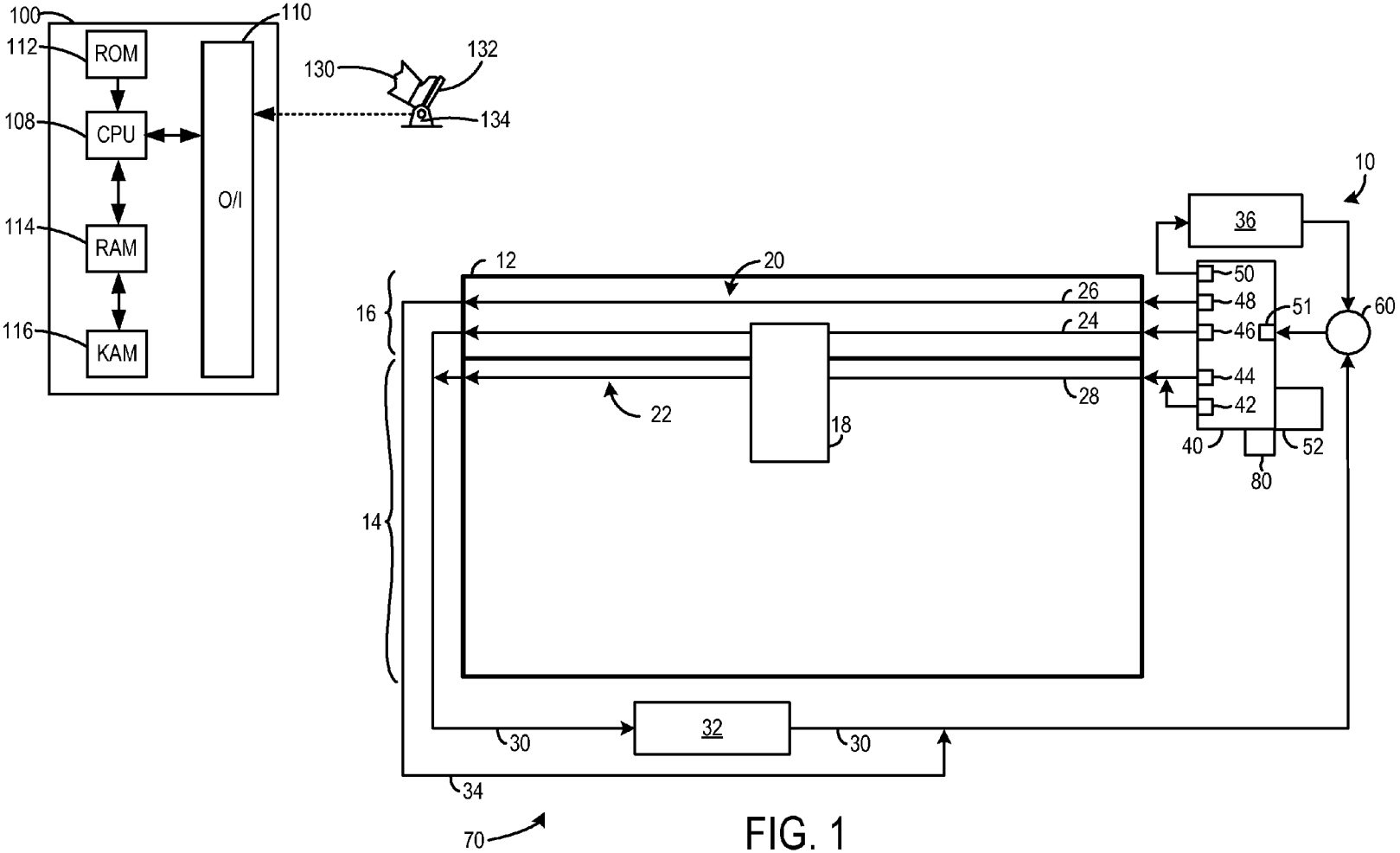
FIG. 1 shows a schematic depiction of an engine and cooling system.

A liquid-cooled internal combustion engine is described herein. The engine may include at least one liquid-cooled cylinder head and having a liquid-cooled cylinder block and having a selector guide valve for the demand-dependent control of a cooling system (e.g., liquid-type cooling arrangement). The selector guide valve may be arranged in a coolant circuit, having at least one inlet and at least three outlets for coolant. The cooling system also includes a recirculation line, in which a heat exchanger is arranged, and a bypass line, which bypasses the heat exchanger arranged in the recirculation line, being provided in order to form the coolant circuit. A method for controlling the selector guide valve of an internal combustion engine of said type is also described herein.

A selector guide valve is used for example in internal combustion engines of the stated type which may be used for motive power in a motor vehicle. Within the context of the present description, the expression "internal combustion engine" encompasses Otto-cycle engines, diesel engines and also hybrid internal combustion engines, which utilize a hybrid combustion process, and hybrid drives which include not only the internal combustion engine but also an electric machine which can be connected in terms of drive to the internal combustion engine and which receives power from the internal combustion engine or which, as a switchable auxiliary drive, additionally outputs power.

Cooling arrangement of an internal combustion engine may take the form of an air-type cooling system or a liquid-type cooling system. On account of the higher heat capacity of liquids, it is possible for significantly greater quantities of heat to be dissipated using a liquid-type cooling system than is possible using an air-type cooling system. Many engines can have a large amount of thermal loading. Therefore, prior internal combustion engines are commonly equipped with liquid-type cooling system. Another reason for this is that internal combustion engines can be supercharged and dense packaging of components may be desirable to increase the engine's compactness. This increased density in packaging has led to an ever greater number of components integrated into the cylinder head or cylinder block. As a result, the thermal loading of the engines, that is to say of the internal combustion engines, is further increased. Additionally, exhaust manifolds can be integrated into the cylinder head in order to be incorporated into a cooling system provided in the cylinder head and so that the manifold does not need to be produced from thermally highly loadable materials, which are expensive, if desired.

Liquid-type cooling systems coolant jackets included in the cylinder head. The coolant jackets include coolant ducts which conduct the coolant through the cylinder head. The one coolant jackets can be fed with coolant at the inlet side via a supply opening, which coolant, after flowing through the cylinder head, exits the coolant jacket at the outlet side via a discharge opening. The heat does not need to be first conducted to the cylinder head surface in order to be dissipated. This is the case in an air-type cooling system. Rather, the coolant may be discharged to the coolant already in the interior of the cylinder head. Here, the coolant can be delivered by a pump arranged in the coolant circuit, such that said coolant circulates. The heat which is discharged to the coolant can thereby discharged from the interior of the cylinder head via the discharge opening, and is extracted from the coolant again outside the cylinder head, for example via a heat exchanger and/or some other suitable component.

Like the cylinder head, the cylinder block may also be equipped with one or more coolant jackets. The cylinder head may however be one of the thermally more highly loaded components because, by contrast to the cylinder block, the head is provided with exhaust-gas-conducting lines, and the combustion chamber walls which are integrated in the head are exposed to hot exhaust gas for longer than the cylinder barrels provided in the cylinder block. Furthermore, the cylinder head has a lower component mass than the block.

If the internal combustion engine has both a liquid-cooled cylinder head and also a liquid-cooled cylinder block, it may be possible for a coolant jacket that is integrated in the cylinder head to be supplied with coolant via the cylinder block, and/or for a coolant jacket integrated in the cylinder block to be supplied with coolant via the cylinder head.

The coolant is commonly composed of a water-glycol mixture provided with additives. In relation to other coolants, water has the advantage that it is non-toxic, readily available and cheap, and furthermore has a very high heat capacity, for which reason water is suitable for the extraction and dissipation of very large amounts of heat, which is basically considered to be advantageous. However, other types of coolant may be used in liquid-cooled engines.

To form a coolant circuit, the outlet-side discharge openings from which the coolant exits the coolant jackets can be connected to the inlet-side supply openings that can serve for the feed of coolant to the coolant jackets, for which purpose a line or multiple lines may be provided. Said lines need not be lines in the physical sense but rather may also be integrated in portions into the cylinder head, the cylinder block or some other component. An example of such a line is the recirculation line in which a heat exchanger is arranged which extracts heat from the coolant. A further example of a line for forming the coolant circuit is the bypass line that bypasses the heat exchanger arranged in the recirculation line.

A cooling system may not be designed to extract the greatest possible amount of heat from the internal combustion engine under all operating conditions. Rather, demand-dependent control of the cooling system may be desirable, which aside from full load also makes allowance for the operating modes of the internal combustion engine in which it is more beneficial for less heat, (e.g., a minimum amount of heat), to be extracted from the internal combustion engine.

To reduce the friction losses and thus the fuel consumption of an internal combustion engine, fast heating of the engine oil, in particular after a cold start, may be desirable. Fast heating of the engine oil during the warm-up phase of the internal combustion engine enables a correspondingly fast decrease in the viscosity of the oil and thus a reduction in friction and friction losses, in particular in the bearings which are supplied with oil, for example the bearings of the crankshaft.

Fast heating of the engine oil in order to reduce friction losses may basically also be abetted by fast heating of the internal combustion engine itself, which in turn is assisted by virtue of a small amount of heat being extracted from the internal combustion engine during the warm-up phase.

In this respect, the warm-up phase of the internal combustion engine after a cold start is an example of an operating mode in which may be desirable for a reduced amount of heat (e.g., a minimum amount of heat) to be extracted from the internal combustion engine.

Control of the cooling system in which the extraction of heat after a cold start is reduced for the purpose of fast heating of the internal combustion engine may be realized through the use of temperature-dependently self-controlling valves, often also referred to as thermostat valves. A thermostat valve of said type has a temperature-reactive element which is impinged on by coolant, where a connecting line which leads through the valve is blocked or opened up, to a greater or lesser extent, as a function of the coolant temperature at the element.

In an internal combustion engine which has both a liquid-cooled cylinder head and also a liquid-cooled cylinder block, it may be desirable for the coolant throughput through the cylinder head and through the cylinder block to be controlled independently of one another and in continuously variable fashion, in particular because the two components are thermally loaded to different degrees and exhibit different warm-up behavior. In this regard, it may be desirable for the coolant stream through the cylinder head and the coolant stream through the cylinder block to be controlled in each case by a dedicated thermostat valve with different opening temperatures. At the start of the warm-up phase, the coolant would not flow but rather would remain stationary in the lines and in the coolant jacket of the cylinder head and/or of the cylinder block, whereby the warming of the coolant and the heating of the internal combustion engine would be accelerated, the warming of the engine oil would be expedited and the reduction in friction losses would be assisted.

The use of two or more thermostat valves however can increase the costs of the control arrangement, the spatial requirement and the weight. Furthermore, control of the cooling system may be provided where it is possible not only for the circulating coolant flow rate or the coolant throughput to be reduced or stopped respectively after a cold start, but also for the thermal management of the internal combustion engine in general to be manipulated.

For driver and passenger comfort, it may be desirable, in particular after a cold start, for a coolant-operated vehicle interior heater to be fed, via a heating circuit line, with coolant that has been pre-warmed in the cylinder head and/or cylinder block. Here, there is a conflict of aims, specifically between, on the one hand, the pre-warming of coolant in the cylinder head or cylinder block in order to provide pre-warmed coolant to the heater, and, on the other hand, the stopping or reduction of the coolant throughput through the cylinder head or cylinder block in order that a reduced amount of heat (e.g., minimum amount of heat) is extracted from the internal combustion engine during the warm-up phase.

Cooling system concepts may be provided in which a so-called proportional valve is positioned at the outlet side or at the inlet side. A proportional valve of said type can, by a single valve body, control both the coolant flow through the cylinder head and also the coolant flow through the cylinder block. Said proportional valve serves for the demand-dependent control of the cooling system, and for the demand-dependent cooling of the internal combustion engine. The costs, weight, and spatial requirement for the control are reduced. The number of components is reduced, as a result of which the procurement costs and assembly costs are fundamentally reduced.

The valve body of the proportional valve may for example be in the form of a rotatable hollow drum with coolant passages open to the exterior surface. A valve housing with a corresponding number of coolant passage ducts serves for the rotatable mounting and accommodation of the drum, which coolant passage ducts can, by rotation of the drum, be connected to or placed in overlap with coolant passages. A proportional valve has at least one inlet for the inflow of coolant and at least one outlet for the outflow of coolant.

A proportional valve, which is for example actively controlled by an engine controller, basically permits characteristic-map-controlled actuation and thus also a coolant temperature that is configured to the present load state of the internal combustion engine. For example, the valve may be controlled to provide a higher coolant temperature at relatively low loads than at high loads, and thus less extraction of heat in part-load operation. Thus, the proportional valve can be controlled by the engine controller to adjust the flows of coolant through the cylinder head and the cylinder block and thus the extracted heat quantities can be adjusted, that is to say controlled, according to demand.

The proportional valve, or the associated valve body, can assume different positions, for example a position suitable for the warm-up phase of the internal combustion engine, in which the coolant flows through the cylinder head but not through the cylinder block. The thermally particularly highly loaded cylinder head would in this case be traversed by a flow of coolant, and cooled. It may be possible for the throughflow rate, and thus the amount of heat extracted from the cylinder head, to be set by adjustment of the drum within said position.

By transferring the proportional valve into a different position, the cylinder block could then be additionally opened up for the coolant, and coolant flows through the cylinder head and the cylinder block. It is possible for the throughflow rate, and thus the amount of heat extracted from the cylinder block, to be set by adjustment of the drum within the position.

The two above positions may be supplemented or replaced by a number of other positions, for example by a position in which the cooling of the cylinder head is also deactivated, that is to say the coolant stream through the cylinder head is stopped entirely. Aside from the cooling circuits for the head and/or the block, it is possible for further coolant circuits to be controlled by the proportional valve, the lines of which coolant circuits are then led through the proportional valve; such further coolant circuits include for example the coolant circuit of a charge-air cooling device, the coolant circuit of an exhaust-gas recirculation cooling device, the coolant circuit of a coolant-operated vehicle interior heater, the coolant circuit of a coolant-operated oil cooler, the coolant circuit of a liquid-cooled exhaust-gas turbocharger, and/or the coolant circuit via a recirculation line or a bypass line or the like.

Proportional valves can also include a drum that serves as a valve body is not only rotatable but also displaceable in translational fashion along the axis of rotation by an adjustment device, whereby the adjustment possibilities are increased. Here, each position realized, that is to say set, by rotation and assigned to a particular angle of rotation gives rise, through additional displacement of the drum, to a multiplicity of further different positions of the drum, such that the number of possible positions of the drum is increased or multiplied many times over.

The use of a proportional valve makes it possible to improve the control of the cooling and to manipulate both the thermal management of the internal combustion engine in the warm-up phase and also the thermal management of the warmed-up internal combustion engine.

In practice, however, proportional valves may malfunction or completely fail, leading to cooling system problems. Contaminants in the coolant, for example sand and/or other particles, may accumulate between the valve housing and the drum that serves as the valve body and lead to jamming of the drum in the housing, with the result that an adjustment of the drum in the housing, that is to say a rotation and/or a displacement, is no longer possible. Such a malfunction may lead to failure of the cooling system such that the throughflow of coolant through the cylinder head and/or through the cylinder block is reduced or stopped entirely, with the result that the internal combustion engine may be thermally overloaded and irreversibly damage may occur.

Furthermore, it has proven to be difficult to meet the cooling demands of all of the coolant circuits, in particular simultaneously and to a full extent, by a single proportional valve. A selector guide valve for the demand-dependent control of a cooling system is described herein which offers many benefits over previous proportional valves. For instance, the selector guide valve described herein enables greater adjustability as well as reliability. Specifically, the selector guide valve described herein provides an improvement of the control of the cooling arrangement and is less susceptible to malfunctions, in particular malfunctions that may be caused by contaminants such as particulates in the coolant. A method for controlling the selector guide valve of an internal combustion engine is also described herein.

As such, a liquid-cooled internal combustion engine having at least one liquid-cooled cylinder head and having a liquid-cooled cylinder block and having a selector guide valve for the demand-dependent control of a cooling system may be provided. The selector guide valve, can be arranged in a coolant circuit and have at least one inlet and at least three outlets for coolant. The cooling system may further include a recirculation line, in which a heat exchanger is arranged, and a bypass line, which bypasses the heat exchanger arranged in the recirculation line, being provided in order to form the coolant circuit. Additionally, the selector guide valve may have two control drums and has a housing for the rotatable coaxial mounting and accommodation of the control drums. The second control drum may be mounted rotatably in a first control drum which is rotatably mounted in the housing. Additionally, the at least one inlet of the selector guide valve can issue into the second control drum. The housing may have at least three duct sections for forming the at least three outlets of the selector guide valve, and each control drum may have at least three openings on the exterior surface, where the at least one inlet is at least connectable to at least one outlet by rotation of at least one control drum.

In one example, the selector guide valve adjustment possibilities are expanded by virtue of a further, second control drum being inserted into the control drum, with the two control drums being coaxially mounted and rotatably accommodated in one housing.

The two control drums can be rotated relative to one another, and each control drum can be rotated independently relative to the housing, that is to say in the housing. Here, each position realized by rotation of the first control drum creates, by rotation of the second control drum, a multiplicity of further different switching positions of the guide apparatus, such that the number of possible positions is increased several times over. This permits the control of a multiplicity of coolant circuits, where the needs of the different circuits can in particular be met simultaneously, if desired. In this respect, the control of the cooling arrangement can be considerably improved (e.g., optimized) by the selector guide valve described herein.

Furthermore, the provision of the second control drum together with the rotation possibilities thereby additionally created makes the selector guide valve, and thus the cooling system, less susceptible to malfunctions. For example, if a grain of sand or some other particle is deposited between the housing and the first control drum such that the first control drum is blocked and can no longer be rotated, it is possible, in the case of the selector guide valve, for the second control drum to be rotated in the housing relative to the first control drum and for different selector positions to be realized, that is to say assumed. In contrast to previous proportional valves, control of the cooling arrangement remains possible by the selector guide valve described herein.

If a grain of sand or some other particle is deposited between the two control drums such that the two control drums are mechanically coupled and can no longer be rotated relative to one another, it remains possible for the two control drums together, that is to say in combination with one another, to be rotated in the housing, and for different selector positions to be realized. In this scenario, too, control of the cooling arrangement remains possible.

The probability of the control of the cooling system being impaired such that the flow of coolant through the cylinder head and/or through the cylinder block is reduced (e.g., stopped entirely) is noticeably reduced, whereby the likelihood of thermal overloading of the internal combustion engine can generally be reduced (e.g., eliminated). It will be appreciated that the selector guide valve may be configured to control the cooling arrangement and is less susceptible to malfunctions, in particular malfunctions that may be caused by contaminants such as sand in the coolant than previous proportional valves.

The three openings of a control drum can be essentially coolant passages, that is to say coolant passages which connect the interior of a control drum to the exterior of the control drum. Said openings may be rectangular, circular, or elliptical or may have any other desired contour, where the diameter may be larger, and preferably is larger, than the length extent in the flow direction transversely with respect to the diameter. The at least three duct sections in the housing do not need to be lines or ducts in the physical sense. Accordingly, the duct sections may also be apertures or hole-like bores. That which has already been stated with regard to the contour of the openings applies with regard to the cross section of the duct sections.

The control drums may not be open at both ends, in one example. Control drums in which one end is closed or both ends are closed are then also control drums have been contemplated.

The switching positions of the guide apparatus are of importance and discussed in greater detail herein. In one example, one of the outlets of the selector guide valve is assigned to the cylinder block of the liquid-cooled internal combustion engine.

As previously discussed, internal combustion engines can be supercharged, whereby the thermal load on the internal combustion engine is increased. In this respect, it may be desirable, for the cylinder block to also be equipped with a cooling system, and for the coolant throughput through the cylinder block to be controlled independently, in particular independently of the cylinder head, because the two components may be thermally loaded to different degrees and exhibit different warm-up behavior. At the start of and during the warm-up phase, however, it may be desirable for the coolant flow through the cylinder block to be stopped or reduced in order to enable warming of the coolant and thus the heating of the internal combustion engine.

In one example, the inlet of the selector guide valve may be connectable, by rotation of at least one control drum, to the outlet assigned to the cylinder block. It is then possible for the coolant throughput through the cylinder block to be controlled, that is to say reduced, increased and stopped, by the selector guide valve.

In another example, one of the outlets of the selector guide valve may be assigned to the cylinder head. The cylinder head may be thermally more highly loaded than the block because, by contrast to the cylinder block, the head has a lower component mass, is equipped with exhaust gas-conducting lines, and the combustion chamber walls integrated in the head may be impinged on for longer by hot exhaust gas. Boosting (e.g., supercharging or turbocharging) of the internal combustion engine, and an integration of the exhaust manifold into the head, additionally increase the thermal loading on the engine.

After a cold start, the cooling system may be configured to decrease (e.g., deactivate) the cooling of the cylinder head, in one example. Specifically, the coolant flow through the cylinder head may be stopped entirely by the selector guide valve. In such an example, the selector guide valve may be in a configuration where the outlet assigned to the cylinder head is blocked. Thus, the inlet of the selector guide valve is connectable, by rotation of at least one control drum, to the outlet assigned to the cylinder head.

As previously mentioned with regard to the cylinder block, the inlet of the selector guide valve may be connectable, by rotation of at least one control drum, to the outlet assigned to the cylinder head. That is to say, variants in which only one control drum has to be rotated in order to permit the coolant flow through the cylinder head, but the other control drum remains in its present position and does not have to be rotated, are possible, when using a selector guide valve described herein. In this connection, it may be desirable if one control drum or both control drums has or have, on a specific circumference, multiple openings along its/their longitudinal axis, where openings may be lined up together circumferentially. On said specific circumference, the control drum then, in effect, permanently opens up the inlet, such that a rotation of the other control drum is sufficient to connect the inlet to an outlet such that coolant flows.

For the reasons stated above, the one control drum may have, on a specific circumference, multiple openings along the axis of rotation, where openings are lined up circumferentially, in one example.

In yet another example, both control drums may have, on a specific circumference, multiple openings along the axis of rotation, which openings are lined up circumferentially, where the specific circumference of the first control drum and the specific circumference of the second control drum are spaced apart along the axis of rotation.

In addition to the cooling circuits for the cylinder head and the cylinder block, additional coolant circuits (e.g., water jackets) to be controlled by the selector guide valve, to which further coolant circuits outlets of the selector guide valve may be assigned. Said coolant circuits are then controlled, in particular activated and deactivated, by rotation of at least one control drum. It is for example possible for the charge-air cooling arrangement, the cooling arrangement of the exhaust-gas recirculation arrangement, a coolant-operated vehicle interior heater, a coolant-operated oil cooler and/or a liquid-cooled exhaust-gas turbocharger to be controlled by the selector guide valve.

In one example, an outlet of the selector guide valve may be connected to the recirculation line. Thus, the inlet of the selector guide valve may be connectable, by rotation of at least one control drum, to the recirculation line.

In yet another example, the outlet of the selector guide valve may be connected to the bypass line. In such an example, the inlet of the selector guide valve may be connectable, by rotation of at least one control drum, to the bypass line.

The heat absorbed by the coolant can be extracted from the coolant in the heat exchanger of the recirculation line, or else the coolant is conducted, via the bypass line, past the heat exchanger directly to the inlet side of the coolant circuit, for example during the warm-up phase of the internal combustion engine, in particular after a cold start. Proportional distribution may likewise be realized, in one example.

In the case of internal combustion engines in which at least one outlet of the selector guide valve is connected to the recirculation line, the selector guide valve can, by rotation of at least one control drum, be moved into an emergency running position in which the inlet of the selector guide valve is connected to the outlet assigned to the cylinder block, and to the outlet connected to the recirculation line, of the selector guide valve.

In the case where an outlet of the selector guide valve is connected to the recirculation line, the selector guide valve may, by rotation of at least one control drum, be moved into an emergency running position in which the at least one inlet of the selector guide valve is connected to the at least one outlet, which is connected to the recirculation line, of the selector guide valve.

The recirculation line may be configured to receive coolant from the cylinder head, if appropriate to the cylinder head and the cylinder block, where heat is extracted from the coolant in the heat exchanger in the recirculation line. In other examples, the recirculation line and the heat exchanger may be positioned upstream of the cylinder block and cylinder head coolant jackets. Therefore, the two examples of the switching positions above may be used in particular as an emergency running position, in which cooling of the cylinder head and of the cylinder block is desired.

In yet another example, the selector guide valve can, by rotation of at least one control drum, be moved into a rest position in which the at least one inlet of the selector guide valve is separated from the at least three outlets of the selector guide valve. In the rest position, the cooling system of the internal combustion engine may be deactivated (e.g., fully deactivated).

In yet another example the outlet of the selector guide valve may be connected to the bypass line and the selector guide valve can, by rotation of at least one control drum, be moved into a first working position in which the inlet of the selector guide valve is separated from the outlet connected to the bypass line, of the selector guide valve. The first working position may be used, for example, for the warm-up phase. In the further course of the heating of the internal combustion engine, it would then be possible, by rotation of at least one of the control drums, for the outlet assigned to the cylinder block to additionally be opened up.

In one example, the outlet of the selector guide valve may be connected to the recirculation line. In such an example, the selector guide valve can, by rotation of at least one control drum, be moved into a second working position in which the inlet of the selector guide valve is separated from the outlet assigned to the cylinder block, and is connected to the at least one outlet connected to the recirculation line, of the selector guide valve. The second working position is suitable for an advanced warm-up phase, and may for example be assumed subsequently to the first working position. In the further course of the heating of the internal combustion engine, it would then be possible, by rotation of at least one control drum, for the at least one outlet assigned to the cylinder block to additionally be opened up.

In one example, the selector guide valve may include at least two outlets are assigned (e.g., connected) to the cylinder block. Additionally in another example, the selector guide valve may include at least two outlets are assigned (e.g., connected) to the recirculation line.

Still further in one example, the selector guide valve may include two outlets are assigned to the cylinder block and/or to the recirculation line and the two outlets may be arranged spaced apart from one another along the axis of rotation of the control drums.

The provision of more than one outlet for a component to be cooled or for a coolant path provides a certain level of redundancy. It will be appreciated that the adjustment possibilities or positions additionally created in this way make the selector guide valve and thus the cooling system less susceptible to malfunctions.

In a further example, the selector guide valve may include an actuator which has a temperature-reactive element impinged on by coolant is provided as the adjustment device for the rotation of the control drum, where the control drum may be rotated as a function of the coolant temperature at the element. The temperature-reactive element may for example expand with rising temperature and contract again with falling temperature, and in so doing rotate the control drum. A restoring element such as a spring may be provided, if desired. The rotation of the control drum may be performed in an automatically controlled fashion. That is to say that the control drum may be passively activated based on the temperature of the temperature-reactive element.

Additionally, a vacuum-operable actuator may be provided in the selector guide valve as the adjustment device for the rotation of the control drum, where the control drum may be controlled as a function of the negative pressure in the vacuum.

Additionally, an electrical adjustment device may be provided in the selector guide valve for the rotation of the control drum. Here, the rotation of the control drum is performed not automatically (e.g., passively) but rather in a targeted (e.g., active) fashion, for example by an engine controller. Therefore, an engine controller may be provided for the control of the adjustment device, in one example.

Additionally, a controller and/or actuator may be configured to transfer the selector guide valve (e.g., control drums) into an emergency running position in the event of a malfunction.

A method for controlling a selector guide valve of a liquid-cooled internal combustion engine of a type described above is also described herein. The method may include a method where demand-dependent control of the cooling system is realized by independent rotation of the two control drums by an actuator. That which has been stated in connection with the internal combustion engine and specifically to the selector guide valve likewise applies to the aforementioned method. Method variants may be used in which, in the event of a malfunction, the selector guide valve is moved, by rotation of at least one control drum, into an emergency running position.

FIG. 1 shows a schematic depiction of a cooling system 10 for an internal combustion engine 12. The cooling system 10 is configured to provide liquid cooling to the engine 12. As such, the engine 12 may be referred to as a liquid-cooled engine 12.

As shown, the engine 12 includes a cylinder block 14 (e.g., liquid-cooled cylinder block) coupled to a cylinder head 16 (e.g., liquid-cooled cylinder head). At least one cylinder 18 is formed in the cylinder head and cylinder block. The engine 12 is configured to implement combustion cycles in the cylinder.

The cooling system 10 includes a cylinder head coolant jacket 20 and a cylinder block coolant jacket 22. The cylinder head coolant jacket 20 includes a first path 24 traversing the cylinder head and a second path 26 traversing the cylinder head 16.

The cylinder block coolant jacket includes a path 28 traversing the cylinder block 14. It will be appreciated that the paths (24, 26, and 28) may each represent a plurality of passages. However broadly speaking the paths (24, 26, and 28) may each include at least one passage traversing the cylinder head 16.

The cooling system 10 further includes a recirculation line 30. The recirculation line 30 may be coupled to the first path 24 and the path 28. Thus, the recirculation line 30 is in fluidic communication with the cylinder head coolant jacket 20 and the cylinder block coolant jacket 22. A heat exchanger 32 is coupled to (e.g., positioned in) the recirculation line 30. The heat exchanger is configured to remove heat from the coolant flowing through the recirculation line 30.

The cooling system 10 further includes a bypass line 34. The bypass line 34 bypasses the heat exchanger 32 and is coupled to the recirculation line downstream of the heat exchanger 32. In this way, coolant can bypass the heat exchanger 32, if desired. The bypass line 34 is coupled to the second path 26 in the cylinder head coolant jacket 20. However in other examples, the bypass line 34 may be coupled to a second path 26 in the cylinder block coolant jacket 22. The cooling system 10 may further include a second heat exchanger 36. The second heat exchanger 36 may be a cabin heater, in one example.

The cooling system 10 also includes a selector guide valve 40 configured to selectively flow coolant to various components in the cooling system. Thus, the selector guide valve 40 is configured to independently deliver coolant to selected components. The selector guide valve 40 may include a plurality of outlets connected to various components in the cooling system such as the cylinder head 16, cylinder block 14, recirculation line 30, bypass line 34, second heat exchanger 36.

The selector guide valve 40 may include a housing enclosing a first control drum, the first control drum enclosing a second control drum. Each of the first and second control drum may be independently rotatable. The control drums may be rotated to selectively provide (e.g., permit/inhibit) coolant flow to desired outlets in the housing of the valve coupled to the various components in the cooling system 10. When the control drums are rotated openings in the control drums can align to provide coolant from the inlet of the valve to desired outlets of the valve. Additionally, when opened, the outlets are configured to flow coolant to the corresponding component that they are coupled to. The selector guide valve 40 can be configured to provide coolant to each of the outlets. Therefore, the valve may be configured to flow coolant only to a single outlet or to a combination of outlets.

Specifically, the selector guide valve 40 includes a first outlet 42 coupled to the cylinder block coolant jacket 22 and a second outlet 44 coupled to the cylinder block coolant jacket 22. Additionally, the selector guide valve 40 includes a third outlet 46 coupled to the cylinder head coolant jacket 20 and a fourth outlet 48 coupled to the cylinder head coolant jacket 20. Specifically, the third outlet 46 is coupled to the first path 24 which is coupled to the recirculation line 30. The fourth outlet 48 is coupled to the second path 26 which is coupled to the bypass line 34. The selector guide valve includes a fifth outlet 50 is coupled to the second heat exchanger 36. It will be appreciated that providing two outlets to the cylinder head coolant jacket and to the cylinder block coolant jacket decreases the likelihood of valve malfunction due to the redundancy in the outlets. For instance, if one outlet is block via particulates the other may clear of obstructions or vice-versa. However, additional or alternate outlet configurations of the outlet of the selector guide valve 40 have been contemplated. For instance, the selector guide valve 40 may include one outlet coupled to the cylinder block and two outlets coupled to the cylinder head coolant jacket or vice-versa. Thus, the selector guide valve may include three outlets, in other examples.

The selector guide valve 40 includes an inlet 51 receiving coolant from the recirculation line 30 and the second heat exchanger 36. Additionally, the cooling system 10 includes a pump 60 configured to flow coolant through the system. Specifically, the pump 60 receives coolant from the recirculation line 30 and the heat exchanger 36. The outlet of the pump 60 is coupled to the inlet 51 of the selector guide valve 40.

An actuator 52 (e.g., vacuum-operable actuator) is configured to enable independent rotation of each of the first and second control drums. In the depicted example, the actuator 52 is positioned external to the selector guide valve 40. However, in other examples the actuator may be integrated into the selector guide valve.

The selector guide valve 40 may be coupled to and controlled by a controller 100, in one example. Specifically, the controller 100 may be configured to initiate independent rotation of the first control drum and the second control drum via the actuator 52. However, in other examples the selector guide valve 40 may be passively controlled via components in the selector guide valve 40 such as the temperature-reactive element 80 and the actuator 52. In one example, the temperature-reactive element 80 may be impinged on by coolant is provided as the adjustment device for the rotation of the control drums in the selector guide valve, where the control drums may be rotatable as a function of the coolant temperature at the element. The temperature-reactive element may for example expand with rising temperature and contract again with falling temperature, and in so doing rotate the control drums. A restoring element such as a spring may be provided, if desired. The rotation of the control drums may be performed in an automatically controlled fashion, in such an example. That is to say that the control drum may be passively activated based on the temperature of the temperature-reactive element.

The controller 100, in this particular example, includes an electronic control unit comprising one or more of an input/output device 110, a central processing unit (CPU) 108, read-only memory (ROM) 112, random-accessible memory (RAM) 114, and keep-alive memory (KAM) 116. Engine controller 100 may receive various signals from sensors coupled to engine 12, including measurement of inducted mass air flow (MAF) from mass air flow sensor (not shown); engine coolant temperature (ECT) from temperature sensor (not shown); exhaust gas air/fuel ratio from exhaust gas sensor (not shown); operator input device 132 (i.e., throttle pedal); etc. As shown, the operator input device 132 can be actuated via a driver 130 and in response to actuation of the operator input device 132 a device sensor 134 provides a pedal position (PP) signal to the controller 100. Furthermore, engine controller 100 may monitor and adjust the position of various actuators based on input received from the various sensors. These actuators may include, for example, the pump 60, the actuator 52, etc. Storage medium read-only memory 112 can be programmed with computer readable data representing instructions executable by processor 108 for performing the methods described below, as well as other variants that are anticipated but not specifically listed thereof.

Additionally, the recirculation line 30, bypass line 34, cylinder block coolant jacket 22, cylinder head coolant jacket 20, and pump 60 may be included in a coolant circuit 70 in the cooling system 10.

Figure 2:
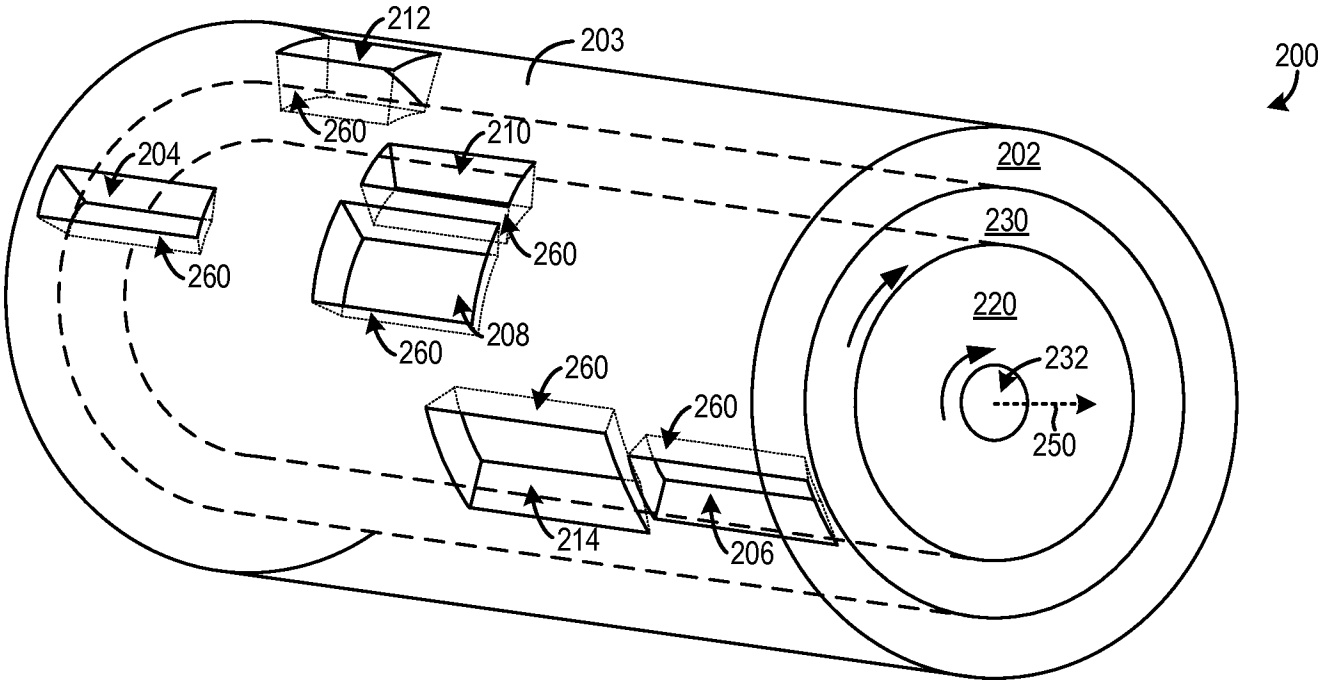
FIG. 2 shows an illustration of an example selector guide valve included in the cooling system shown in FIG. 1.

FIG. 2 shows an illustration of an exemplary selector guide valve 200. The selector guide valve 200 is an example of the selector guide valve 40 shown in FIG. 1. As shown, the selector guide valve 200 includes a housing 202 having an exterior surface 203. The housing 200 includes six outlets extending (e.g., radially extending) through the housing 202. Specifically, a first outlet 204 is connected to a cylinder block coolant jacket such as the cylinder block coolant jacket 22 shown in FIG. 1. A second outlet 206 is configured to connect to the cylinder block coolant jacket. However, in other examples, the second outlet 206 may be configured to connect to a second heat exchanger (e.g., the second heat exchanger 36 shown in FIG. 1). A third outlet 208 may be configured to connect to a cylinder head coolant jacket (e.g., the first path 24 in the cylinder block coolant jacket 20 coupled to the recirculation line 30 and the heat exchanger 32, shown in FIG. 1). A fourth outlet 210 may be configured to connect to the cylinder head coolant jacket (e.g., the second path 26 in the cylinder block coolant jacket 20 coupled to the bypass line 34, shown in FIG. 1. A fifth outlet 212 may be configured to connect to a second heat exchanger (e.g., the second heat exchanger 36 shown in FIG. 1). A sixth outlet 214 may be configured to connect to the cylinder head coolant jacket (e.g., the first path 24 in the cylinder block coolant jacket 20 coupled to the recirculation line 30 and the heat exchanger 32, shown in FIG. 1). Each of the outlets (204, 206, 208, 210, and 212) includes a duct section 260 extending through the housing to form the outlets.

The selector guide valve 200 further includes a first control drum 220 independently rotatable and including an inlet 222 configured to receive coolant from a pump (e.g., the pump 60 shown in FIG. 1). The selector guide valve 200 further includes a second control drum 230 independently rotatable. The axis of rotation 250 of the first control drum 220 and the second control drum 230 is illustrated. As shown, the first and second control drums (220 and 230) share a common axis of rotation. Additionally, the control drums (220 and 230) take the form of hollow cylinders in the depicted example. However, other shapes of the control drums have been contemplated.

The housing 202 circumferentially surrounds the second control drum 230 and the second control drum 230 circumferentially surrounds the first control drum 220. The first control drum 220 includes a plurality of coolant openings extending (e.g., axially extending) through the drum. Likewise the second control drum 230 includes a plurality of coolant openings extending (e.g., axially extending) through the drum. It will be appreciated that the coolant openings in both of the first and second control drum can be aligned (e.g., axially and/or radially aligned) to provide fluidic communication between the inlet 232 and selected outlets (204, 206, 208, 210, and/or 212) in the valve 200. In this way, coolant may be selectively provided to various components in the cooling system 10. The inlet 232 may be in fluidic communication with upstream components such as the pump 60, recirculation line 30, etc., shown in FIG. 1. In this way, the selector guide valve 200 can direct coolant to desired locations in the coolant circuit.

Figure 3:
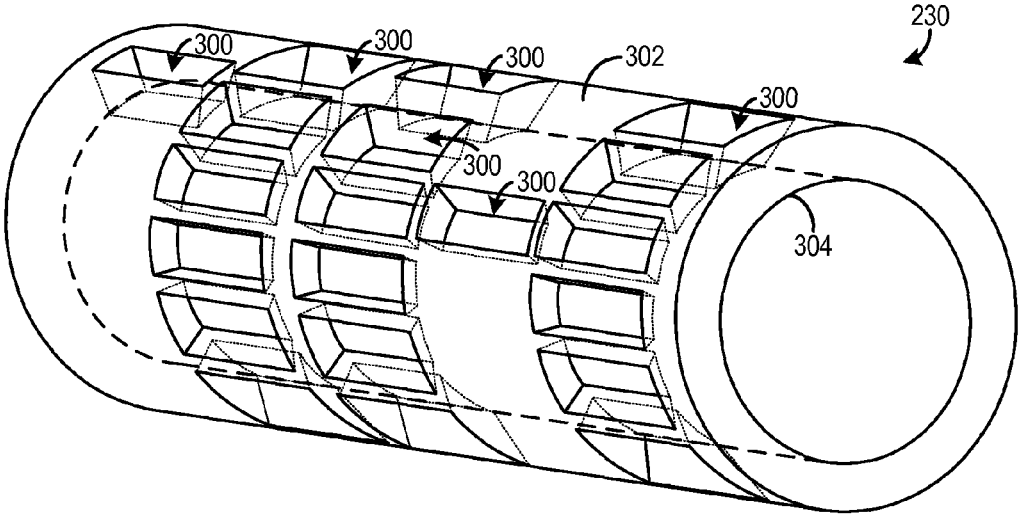
FIG. 3 shows a detailed view of the second control drum included in the selector guide valve, shown in FIG. 2.

FIG. 3 shows a detailed view of the second control drum 230. As illustrated, the second control drum 230 includes a plurality of coolant openings 300. The coolant openings 300 extend through (e.g., axially extend through) the second control drum 230. The openings 300 extend through an exterior surface 302 and an interior surface 304 of the second control drum 230.

Figure 4:
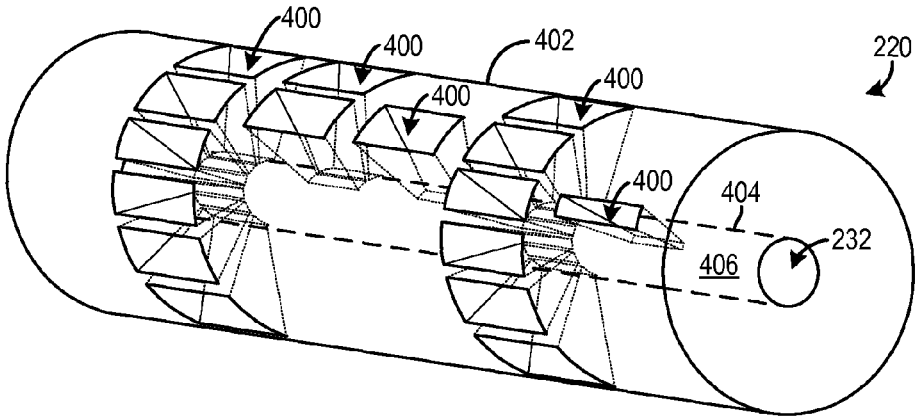
FIG. 4 shows a detailed view of the first control drum included in the selector guide valve, shown in FIG. 2.

FIG. 4 shows a detailed view of the first control drum 220. As illustrated, the first control drum 220 includes a plurality of coolant openings 400. The coolant openings 400 extend through (e.g., axially extend through) the first control drum 220. The openings 400 extend through an exterior surface 402 and an interior surface 404 of the first control drum 220. The interior surface 404 defines a boundary of the inlet passage 406. The inlet 232 opens into the inlet passage 406 and provide coolant thereto.

It will be appreciated that the second control drum 230 shown in FIG. 3 and the first control drum 220 shown in FIG. 4 can be independently rotated to align (e.g., radially align) at least a portion of the coolant openings 300 and 400 to provide fluidic communication between the inlet 232 and one or more of the outlets (204, 206, 208, 210, and/or 212) in the housing 202 shown in FIG. 2.

Figure 5A:
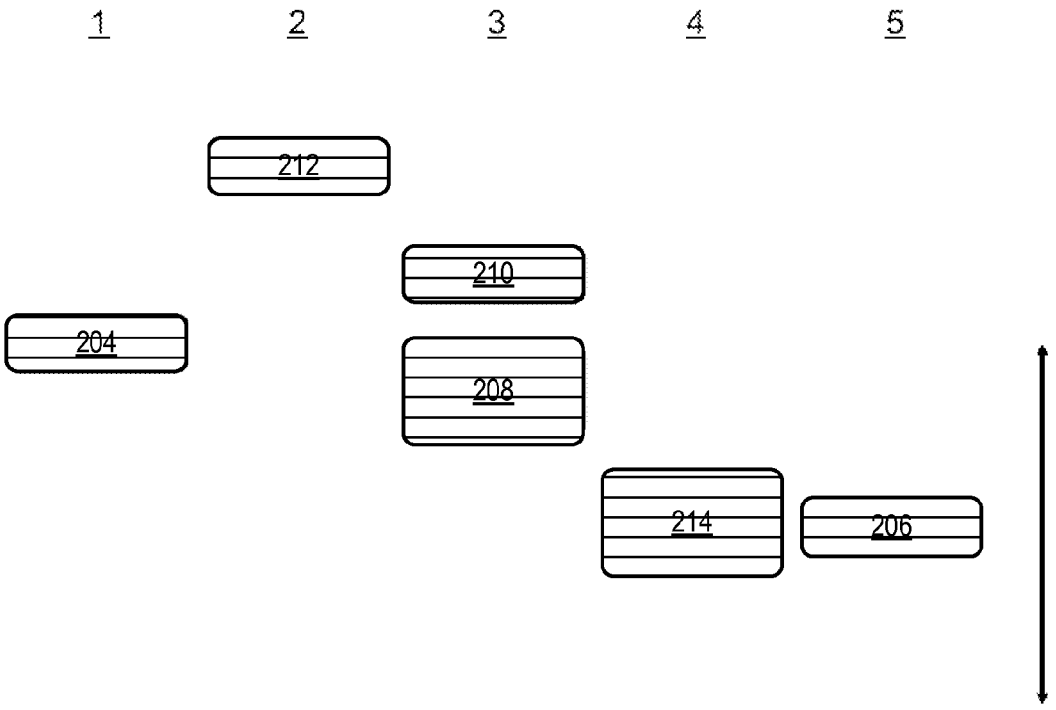
FIG. 5A schematically shows the outlets in the housing of the selector guide valve shown in FIG. 2 applied to a 2-dimensional surface.

FIG. 5A schematically shows the developed view of the outlets of the housing 202, shown in FIG. 2, applied to a 2-dimensional flat surface as opposed to a cylindrical surface. The direction of rotation of the control drums is indicated on the right by a double arrow. Therefore in this example, rotation of a control drum equates to a displacement of the developed view of the inner surface along the double arrow. Along the axis of rotation of the control drum, which runs perpendicular to the double arrow, outlets 204, 206, 208, 210, and 212 are arranged in five rows, that is to say in five columns 1, 2, 3, 4, 5. Each column extends on a specific circumference of the surface of the housing 202.

Outlets (204 and 206), assigned to the cylinder block, of the selector guide valve are provided both in the first column 1 and also in the fifth column 5. In the third column 3 there are arranged two outlets (208 and 210) assigned to the cylinder head, such as the cylinder head 16 shown in FIG. 1. One outlet 208 assigned to the cylinder head may be connected to a recirculation line (e.g., recirculation line 30 shown IN FIG. 1), via which coolant can be conducted through a heat exchanger. Additionally, one outlet 210 assigned to the cylinder head may be connected to a bypass line (e.g., bypass line 34 shown in FIG. 1), which bypasses the heat exchanger. A second outlet 214 which is assigned to the cylinder head and connected to the recirculation line may be arranged in the fourth column 4. A second heat exchanger (e.g., vehicle interior heater), such as heat exchanger 36 shown in FIG. 1, can be supplied with coolant via an outlet 212 arranged in the second column 2.

Figure 5B:
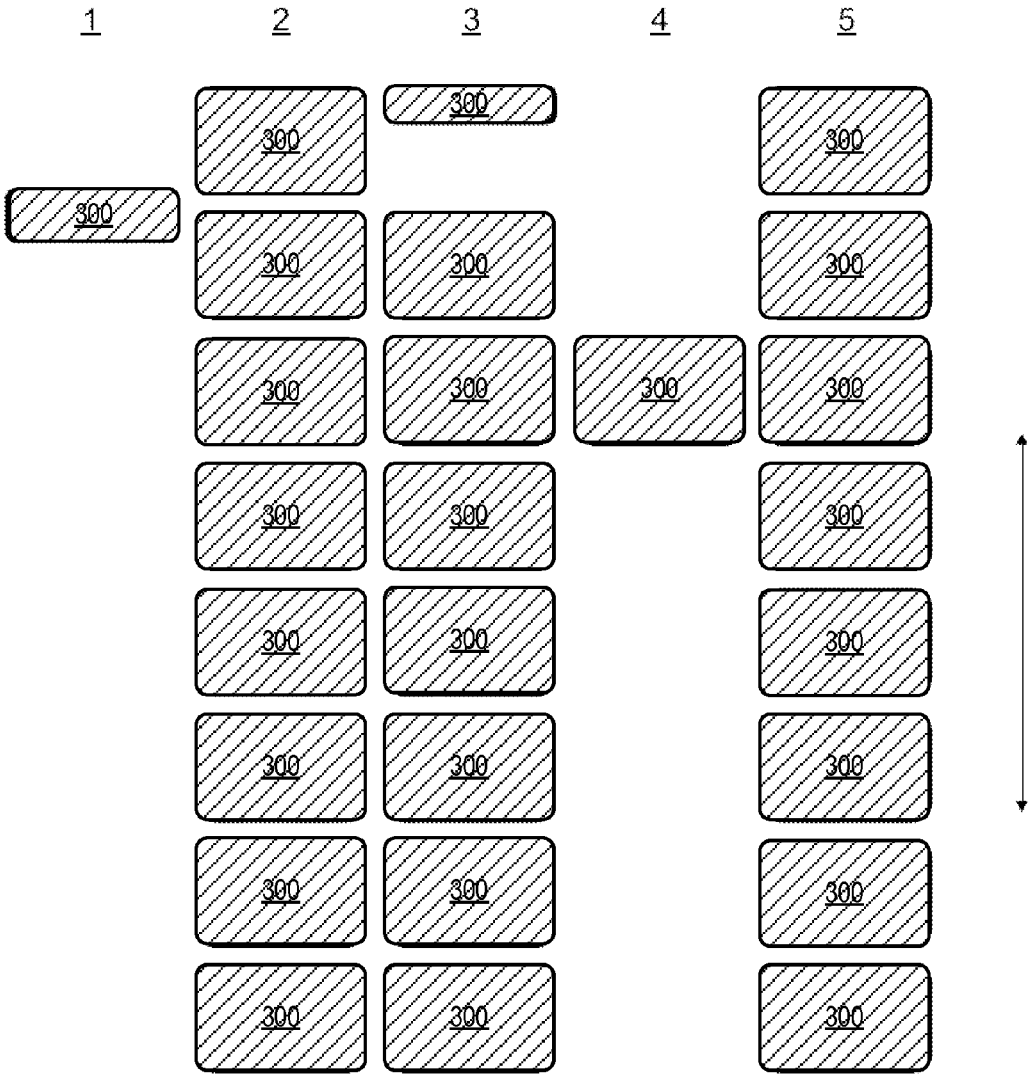
FIG. 5B schematically shows the openings in the second control drum of the selector guide valve shown in FIG. 2 applied to a 2-dimensional surface.

FIG. 5B schematically shows the developed view of the outlets of the second control drum 230, shown in FIG. 2, applied to a 2-dimensional flat surface as opposed to a cylindrical surface.

The second control drum 230 has a multiplicity of openings 300. Multiple openings 300 extend in the second column 2 and in the fifth column 5, where openings 300 are lined up together circumferentially (e.g., axially and radially). On these specific circumferences, the second control drum, in effect, opens up the inlet of the selector guide valve, such that a rotation of the first control drum is sufficient to connect the inlet 232 of the selector guide valve 200, shown in FIG. 2 to the outlet 204, which is arranged in the fifth column 5 and which is assigned to the cylinder block, and/or the vehicle interior heater.

By contrast, in each case only one opening 300 is provided in the first column 1 and in the fourth column 4. Additionally, only one gap is located in the third column 3, in the depicted example. However, other coolant opening layouts have been contemplated.

Figure 5C:
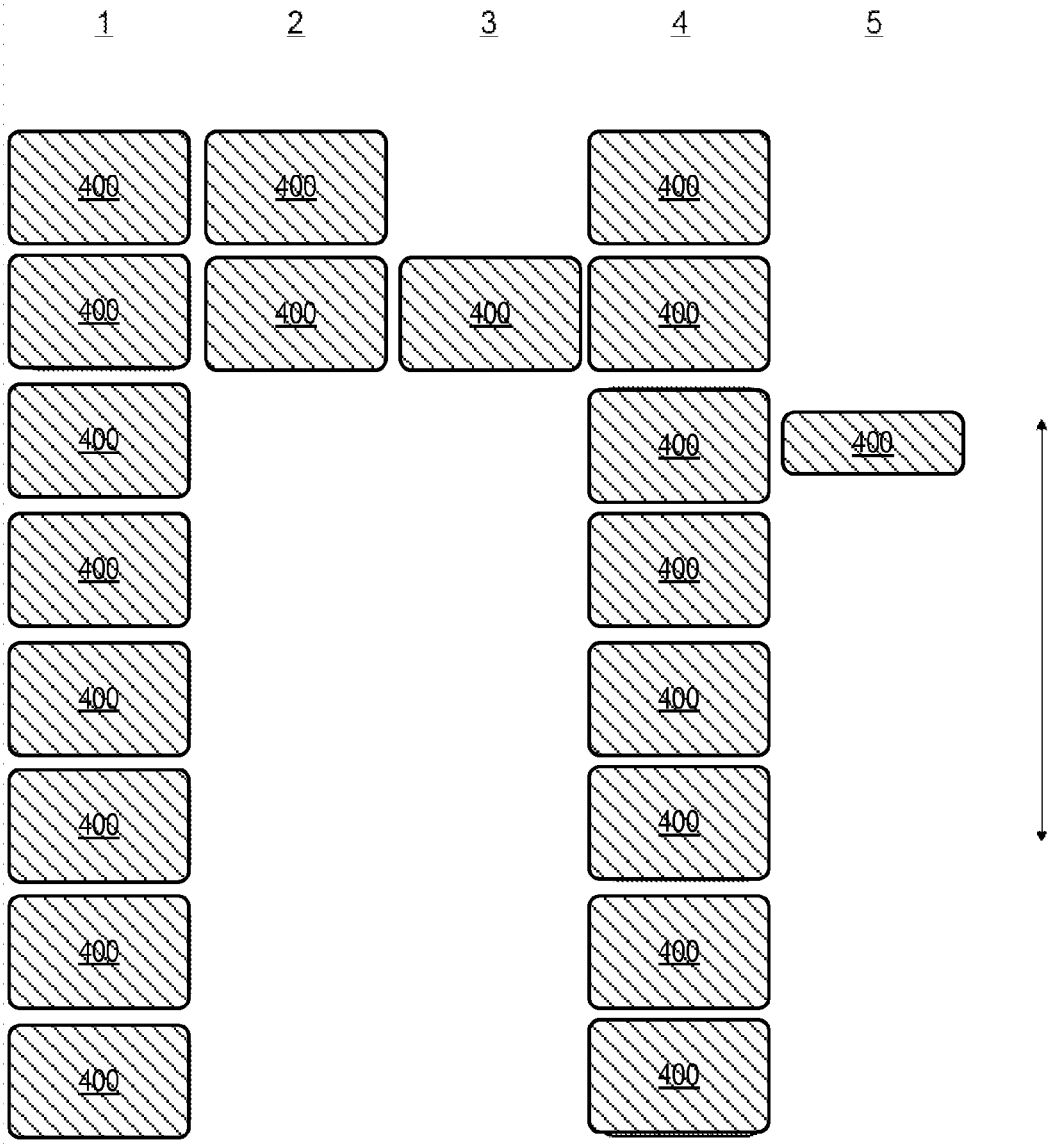
FIG. 5C schematically shows the openings in the first control drum of the selector guide valve shown in FIG. 2 applied to a 2-dimensional surface.

FIG. 5C schematically shows the developed view of the outlets of the first control drum 220, shown in FIG. 2, applied to a 2-dimensional flat surface as opposed to a cylindrical surface.

Whereas the second control drum 230 has in each case only one opening 300, shown in FIG. 3, in the first column 1 and in the fourth column 4, it is the case in the first control drum that multiple openings 400 extend in the first and fourth columns 1, 4, which openings are lined up together circumferentially without gaps. On these specific circumferences, the first control drum 220, in effect, opens up the inlet 232 of the selector guide valve 200, shown in FIG. 2, such that a rotation of the second control drum 230 is sufficient to connect the inlet of the selector guide valve to the outlet 204, which is arranged in the first column 1 and which is assigned to the cylinder block, and/or to the outlet 208 and/or 214, which is arranged in the fourth column 4 and which is assigned to the cylinder head and to the recirculation line. By contrast, in each case only one opening 400 is provided in the third column 3 and in the fifth column 5.

Figure 6:
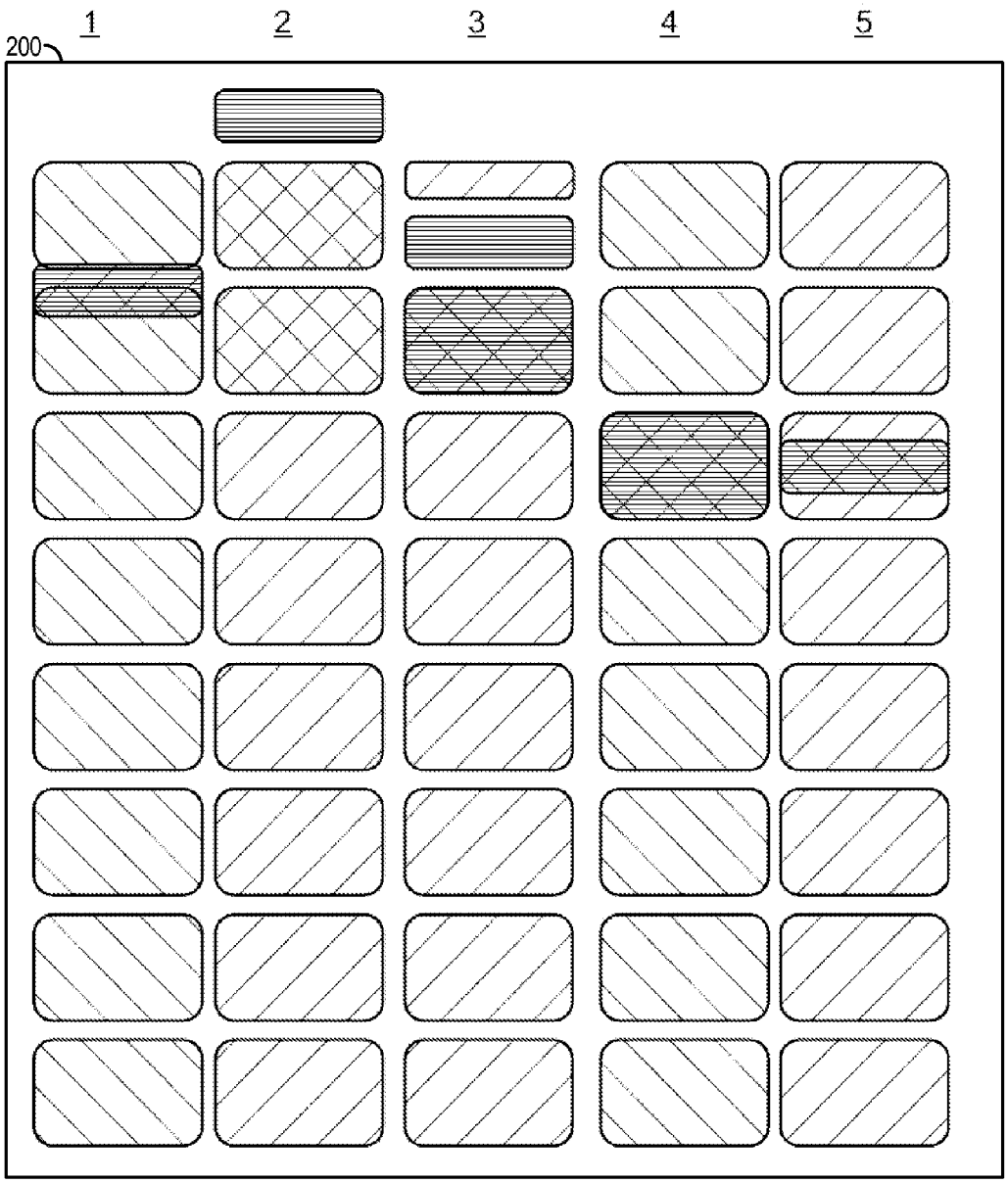
FIG. 6 shows the views illustrated in FIGS. 5A-5C in combination with one another in an emergency running position of the selector guide valve.

FIG. 6 shows the developed views illustrated in FIGS. 5A-5C in combination with one another in an emergency running position of the selector guide valve 200.

In the emergency running position, the selector guide valve 200 opens up both the outlet 204 provided in the first column 1 and also the outlet 204 provided in the fifth column 5, said outlets being assigned to the cylinder block, such that coolant flows through the block. Furthermore, the outlets 208 and/or 212, assigned to the cylinder head and to the recirculation line, of the third and fourth columns 3, 4 are opened up, such that coolant circulates through the cylinder head of the internal combustion engine. In the emergency running position, heat is extracted from the coolant in the heat exchanger of the recirculation line.

Figure 7:
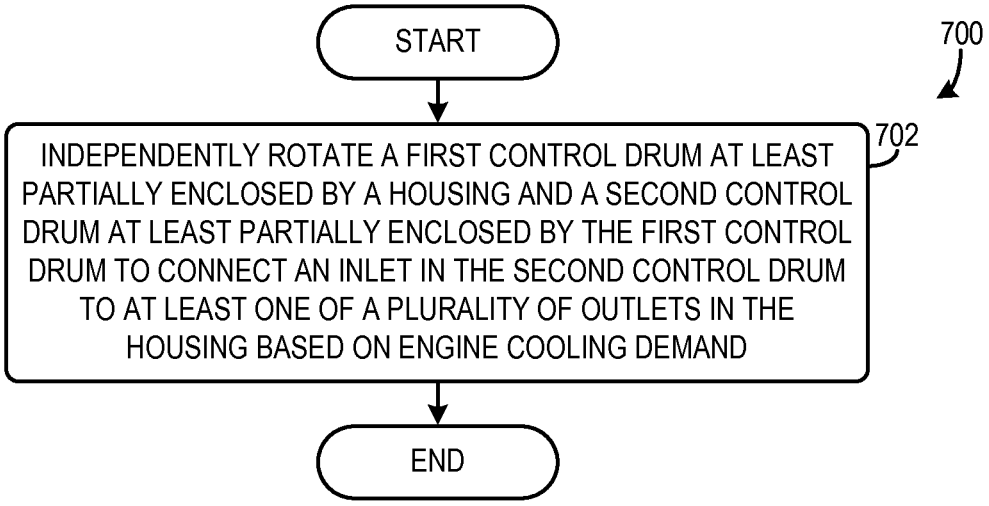
FIG. 7 shows a method for operation of a selector guide valve.

FIG. 7 shows a method 700 for controlling a selector guide valve. The method 700 may be used to control the selector guide valve discussed above with regard to FIGS. 1-6 or may be used to control another suitable selector guide valve.

At 702 the method includes independently rotating a first control drum at least partially enclosed by a housing and a second control drum at least partially enclosed by the first control drum to connect an inlet in the second control drum to at least one of a plurality of outlets in the housing based on engine cooling demand. In one example, each of the first control drum and the second control drum may include a plurality of openings providing the connection between the inlet and the plurality of outlets and where the one of the outlets is connected to a cylinder head coolant jacket and one of the outlets is connected to a cylinder block coolant jacket.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling a selector guide valve comprising:

independently rotating a first control drum about a longitudinal axis of rotation, the first control drum at least partially enclosed by a housing and a second control drum at least partially enclosed by the first control drum to connect a first inlet in the second control drum to at least one of a plurality of outlets in the housing based on engine cooling demand; and after the independent rotation of the first control drum, independently rotating the second control drum about the longitudinal axis of rotation to connect a second inlet in the second control drum to one of the plurality of outlets in the housing.

2. The method of claim 1, where each of the first control drum and the second control drum includes a plurality of openings providing the connection between the first and second inlets and the plurality of outlets and where the one of the plurality of outlets is connected to a cylinder head coolant jacket and one of the plurality of outlets is connected to a cylinder block coolant jacket.

* * * * *